US009478325B2

(12) United States Patent
Watanabe et al.

(10) Patent No.: US 9,478,325 B2
(45) Date of Patent: Oct. 25, 2016

(54) DISCHARGE SURFACE TREATMENT METHOD AND COATING BLOCK FOR DISCHARGE SURFACE TREATMENTS

(71) Applicants: Mitsutoshi Watanabe, Tokyo (JP); Hiroyuki Ochiai, Tokyo (JP); Hiroki Yoshizawa, Tokyo (JP); Yukihiro Shimoda, Tokyo (JP); Masayoshi Shiino, Tokyo (JP)

(72) Inventors: Mitsutoshi Watanabe, Tokyo (JP); Hiroyuki Ochiai, Tokyo (JP); Hiroki Yoshizawa, Tokyo (JP); Yukihiro Shimoda, Tokyo (JP); Masayoshi Shiino, Tokyo (JP)

(73) Assignee: IHI CORPORATION, Tokyo (JP)

( * ) Notice: Subject to any disclaimer, the term of this patent is extended or adjusted under 35 U.S.C. 154(b) by 452 days.

(21) Appl. No.: 13/762,833

(22) Filed: Feb. 8, 2013

(65) Prior Publication Data

US 2013/0146822 A1 Jun. 13, 2013

Related U.S. Application Data

(62) Division of application No. 12/865,040, filed as application No. PCT/JP2009/051620 on Jan. 30, 2009, now abandoned.

(30) Foreign Application Priority Data

Jan. 30, 2008 (JP) ..... 2008-019351

(51) Int. Cl.
*H01B 1/08* (2006.01)
*C23C 26/00* (2006.01)

(52) U.S. Cl.
CPC ..... *H01B 1/08* (2013.01); *C23C 26/00* (2013.01)

(58) Field of Classification Search
CPC ..... H01B 1/00; H01B 1/02; H01B 1/08
See application file for complete search history.

(56) References Cited

U.S. PATENT DOCUMENTS 3,397,968 A * 8/1968 Lavendel ..... B22F 3/11 419/10
5,693,240 A 12/1997 Magara et al.
2006/0035068 A1* 2/2006 Ochiai et al. ..... 428/306.6

(Continued)

FOREIGN PATENT DOCUMENTS

EP 1 544 321 A1 6/2005
JP 8 300227 11/1996
JP 2001 279465 10/2001

(Continued)

OTHER PUBLICATIONS

Combined Office Action and Search Report issued Jan. 4, 2013 in Chinese Patent Application No. 200980103304.8 with English language translation.

(Continued)

*Primary Examiner* — Mark Kopec
(74) *Attorney, Agent, or Firm* — Oblon, McClelland, Maier & Neustadt, L.L.P.

(57) ABSTRACT

Employing a compact molded from powder of metal or the like as an electrode 11, generating pulsed discharges between the electrode 11 and a treating portion Wa of work W in working oil L as a mixture with powder of semiconductor or conductor mixed therein, using discharge energy thereof for locally fusing surface regions of the treating portion Wa of work W, showering molten pieces of electrode material or reactants of the electrode material onto the treating portion Wa of work W, forming a covering film C on the treating portion Wa of work W.

7 Claims, 7 Drawing Sheets

(56) References Cited

U.S. PATENT DOCUMENTS

| | | | |
|---|---|---|---|
| 2006/0169596 | A1 | 8/2006 | Goto |
| 2010/0119864 | A1 | 5/2010 | Ochiai et al. |

FOREIGN PATENT DOCUMENTS

| | | | |
|---|---|---|---|
| JP | 2002 69664 | | 3/2002 |
| JP | 2002-103142 | A | 4/2002 |
| JP | 2004 137576 | | 5/2004 |
| JP | 2005 213554 | | 8/2005 |
| JP | 2007-70712 | | 3/2007 |
| JP | 2007-246294 | | 9/2007 |
| WO | WO 2008/117802 | A1 | 10/2008 |

OTHER PUBLICATIONS

Wansheng Zhao, et al., "Research and Development of Mirror Surface Machining using Powder-Mixed EDM", China Mechanical Engineering, vol. 12, No. 4, Apr. 30, 2001, pp. 466-469 with English abstract.

Extended European Search Report issued Feb. 8, 2012 in European Patent Application No. 09705269.0.

Japanese Office Action issued Sep. 18, 2012, in Patent Application No. 2009-551612.

Office Action issued Oct. 20, 2015 in European Patent Application No. 09 705 269.0.

* cited by examiner (a)

(b)

(a)

EMBODIMENT EXAMPLE 2

(b)

COMPARATIVE EXAMPLE 2

(a)

(b)

DISCHARGE SURFACE TREATMENT METHOD AND COATING BLOCK FOR DISCHARGE SURFACE TREATMENTS

TECHNICAL FIELD

The present invention relates to a discharge surface treatment method of forming a covering film on a treating portion of work using discharge energy, and a coating block for discharge surface treatments.

BACKGROUND ART

There have been developments of various techniques for surface treatment methods of forming a covering film on a treating portion of work such as an engine component, involving recent active developments, in particular, of discharge surface treatment methods using discharge energy (Japanese Patent Application Laying-Open Publication Nos. 8-300227 and 2005-213554).

These discharge surface treatment methods included using a compression-molded compact (a coating block) of powder of metal or the like as an electrode, generating pulsed discharges between the electrode and a treating portion of work in working oil. This involved making use of attendant discharge energy, causing molten pieces of an electrode material or reactants of the electrode material to be showered onto the treating portion of work, affording to form a covering film onto the treating portion of work.

SUMMARY OF THE INVENTION

There was a certain amount of pieces of electrode material or the like showered onto the treating portion of work, of which about half could fix (adhere) to the treating portion of work, forming a covering film thereon, while the rest was unable to fix to the treating portion of work, failing to provide a sufficient enhanced fixation ratio (film forming rate) of electrode material or the like. Therefore, the yield of electrode material was degraded, resulting in a high treatment cost of discharge surface treatment, as a problem.

Further, to prevent concentrated discharges from being continued in discharge surface treatment, upon occurrences of discharge concentration the discharge was paused from time to time. In such the discharge surface treatment, time intervals between discharges were extended, resulting in an elongated treating time, with an insufficient enhanced productivity, as a problem.

It is an object of the present invention to provide a new discharge surface treatment method affording to solve the problems described.

To this end, according to a first aspect of the present invention there is a discharge surface treatment method of forming a covering film on a treating portion of work using discharge energy, the discharge surface treatment method comprising: preparing an electrode as a compact molded from one of a powder of metal, a powder of metal compound, a powder of ceramics, and a mixed powder of at least two of them; generating pulsed discharges between the electrode and a treating portion of work in a volume of working oil prepared as a mixture with one of a powder of semiconductor, a powder of conductor, a powder of non-conductive particles; and a mixed powder of at least two of them, and using discharge energy thereof for locally fusing surface regions of the treating portion of work, showering molten pieces of a material of the electrode or a reactant of the electrode material onto the treating portion of work, forming a covering film on the treating portion of work.

According to a second aspect of the present invention there is a coating block for discharge surface treatments of forming a covering film on a treating portion of work using discharge energy, the coating block for discharge surface treatments comprising a sintered compact of one of electrode materials being a powder of metal, a powder of metal compound, a powder of ceramics, and a mixed powder of at least two of them, the one electrode material being combined with powder of a semiconductor ceramics mixed therein.

BEST MODE FOR CARRYING OUT THE INVENTION

First Embodiment

There will be described a first embodiment of the present invention with reference to FIG. 1.

Figure 1:
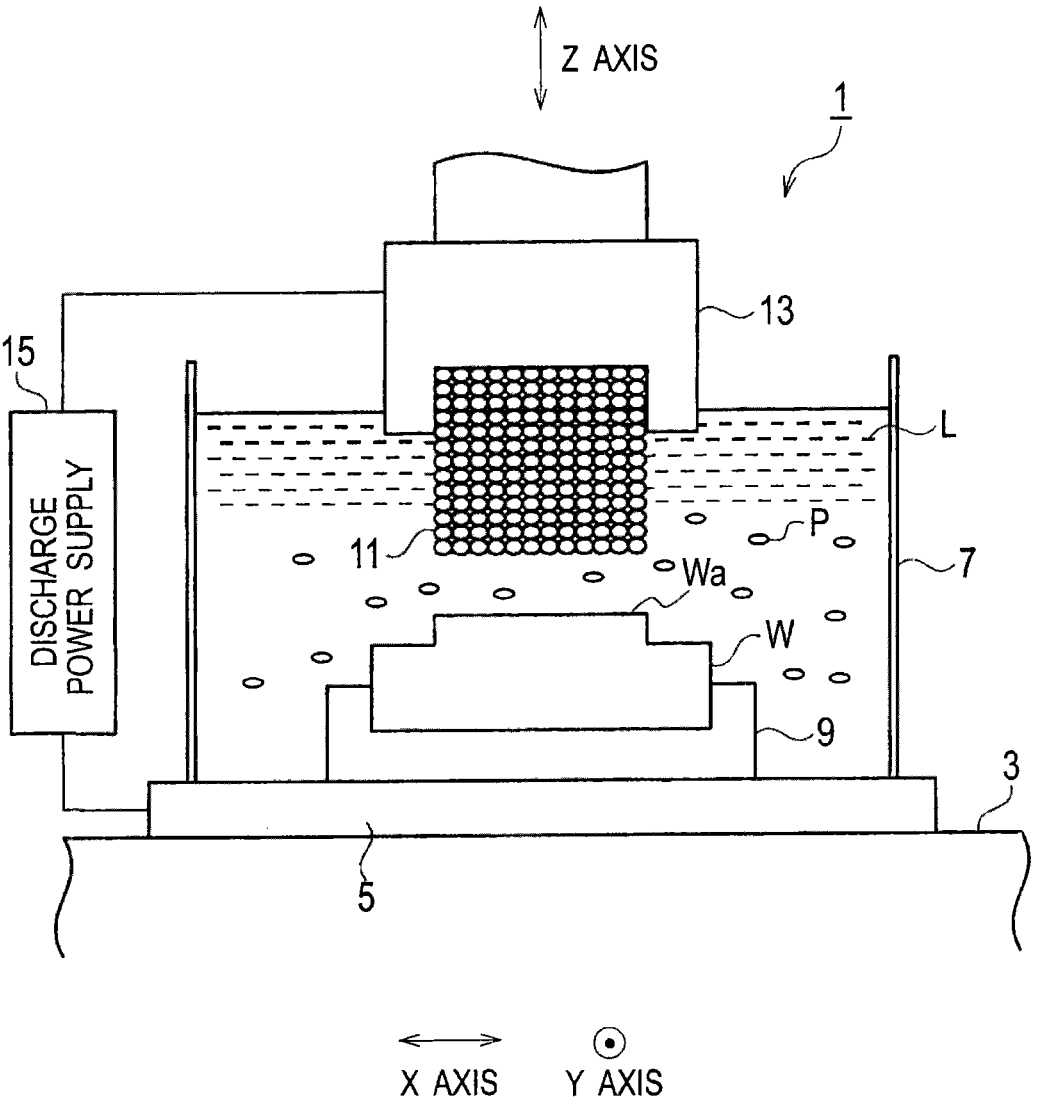
FIG. 1 is a schematic illustration of a discharge surface treatment system employed in a discharge surface treatment method according to a first embodiment of the present invention.

FIG. 1 illustrates a discharge surface treatment system 1 employed in a discharge surface treatment method according to the first embodiment, that includes a bed 3, and a table 5 mounted on the bed 3. On the table 5 there is placed an oil tank 7 with a volume of electrically insulating working oil L stored therein, having a work jig 9 put in the oil tank 7, the work jig 9 being configured to set thereon a work W such as an engine component.

Above the tale 5 there is an electrode 11 held by an electrode holder 13 set in position. The electrode holder 13 is adapted to move relative to the table 5 by combination of an X-axis servo motor (non-depicted) drivable for displacements in the X-axis direction, a Y-axis servo motor (non-depicted) drivable for displacements in the Y-axis direction, and a Z-axis servo motor (non-depicted) drivable for displacements in the Z-axis direction.

The electrode holder 13 as well as the work jig 9 is electrically connected with a discharge power supply 15. The discharge power supply 15 may be a known discharge power supply such as that disclosed in Japanese Patent Application Laying-Open Publication No. 2005-213554, and configured with capacitors, switching elements, resistor elements, and the like.

The electrode 11 is comprised of a compact (a coating block) as a compression mold of powder of a chrome-containing cobalt alloy. It is noted that the electrode 11 is not limited to a compact as a compression mold of powder of a chrome-containing cobalt alloy, and may be a compact molded from one of a powder of a metal or metals, a powder of a metal compound or metal compounds (with an alloy or alloys inclusive), a powder of ceramics, and a mixed powder of at least two of those powders.

Figure 2:
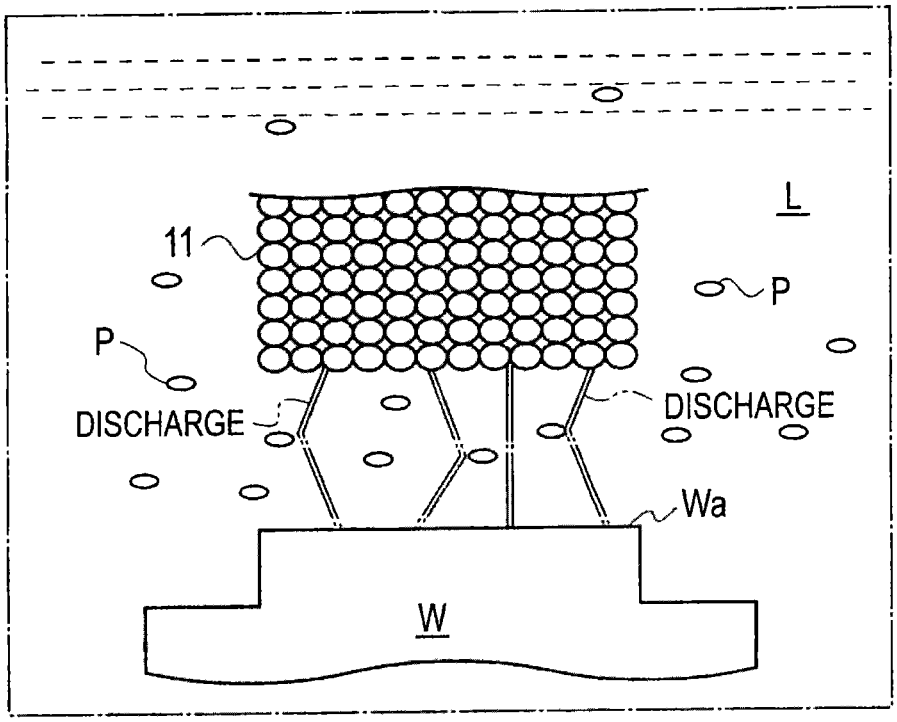
FIG. 2 is a set of illustrations describing the discharge surface treatment method according to the first embodiment of the present invention.
Figure 2:
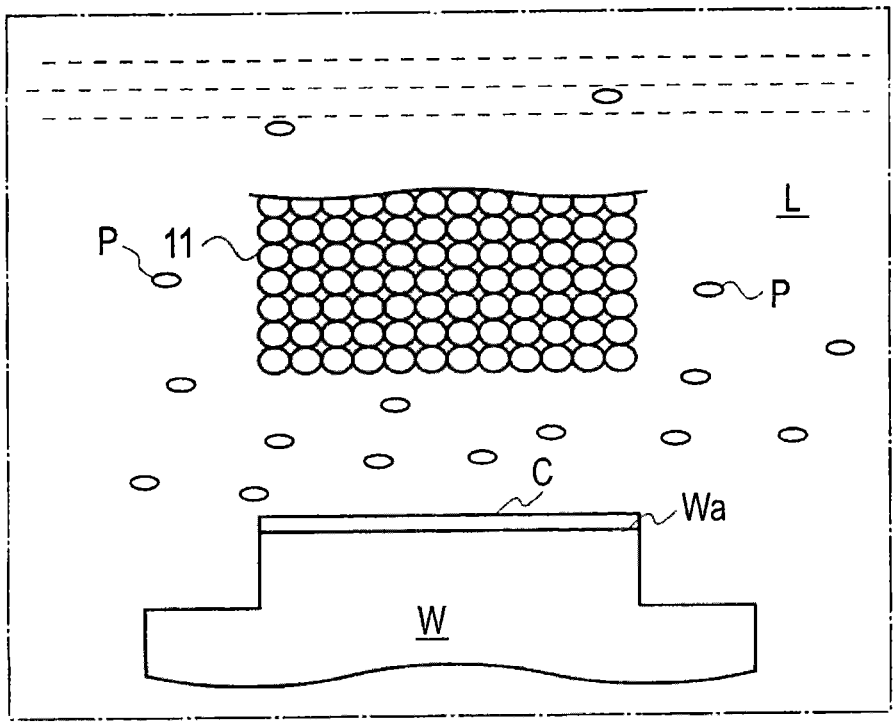

Description is now made of the discharge surface treatment method according to the first embodiment, with reference to FIG. 2.

The discharge surface treatment method according to the first embodiment is based on a new knowledge such that in a state of working oil L having mixed particles P of powder of semiconductor or conductor such as Si or TiC for instance, there may be generation of pulsed discharges between an electrode 11 as a compression mold of powder of a chrome-containing cobalt alloy and a portion Wa of work W to be treated, to have dispersed discharges during discharge surface treatment, allowing for a sufficient enhanced fixation ratio (film forming rate), such as that of electrode material, to the treating portion Wa of work W. This may be thought due to particles P of powder of semiconductor or conductor mixed in working oil L, causing discharges to be dispersed, decreasing local treatment temperatures, suppressing evaporation of electrode material.

For discharge surface treatment to a portion Wa of work W to be treated, first there comes setting the work W to the jig 9, followed by driving the X-axis servo motor and/or the Y-axis servo motor for moving the electrode holder 13 together with the electrode 11 to displace in the X-axis direction and/or the Y-axis direction relative to the table 5, thereby placing the electrode 11 in preset position opposite to the portion Wa of work W to be treated. This is followed by driving the Z-axis servo motor for moving the electrode holder 13 together with the electrode 11 to reciprocally displace in the Z-axis direction, while operating the discharge power supply 15 to have pulsed discharges generated, as illustrated in FIG. 2(*a*), between the electrode 11 and the treating portion Wa of work W in working oil L in a state having particles P of semiconductor or conductor powder mixed therein. This involves attendant discharge energies locally fusing surface regions of the treating portion Wa of work W, while showering molten pieces of electrode material or reactants of the electrode material onto the treating portion of work W, affording as illustrated in FIG. 2(*b*) to form a covering film C on the treating portion Wa of work W.

Those particles P of powder of semiconductor or conductor added to working oil L have their sizes within a range of 0.3 to 2.5 μm. For the particles P of semiconductor or conductor powder, there is a lower limit of size set to 0.3 μm, because of a concern to appear if under 0.3 μm, for possible reduction of a fixation ratio of electrode material or the like to the treating portion Wa of work W. On the other hand, for the particles P of semiconductor or conductor powder, there is an upper limit of size set to 2.5 μm, because of a concern to appear if over 2.5 μm, for possible unstable discharges between the electrode 11 and the treating portion Wa of work W.

For powder of Si used as powder P of semiconductor or conductor, the amount of Si powder mixed in working oil L is set within a range of 0.5 to 30 g/l, and for powder of TiC used as powder P of semiconductor or conductor, the amount of TiC powder mixed in working oil L is set within a range of 1 to 100 g/l.

It is noted that powders used as additives in working oil L may involve those of elements or alloys constituting residues or major components of the electrode 11, encompassing oxides, carbides, nitrides, and borides, as well as particles or short fibers made of carbon. For uniform generation of discharges, about the electrode 11 there may be dispersed non-conductive particles or semi-conductive particles to be hardly reactive with electrode material in view of easy separation. The dispersion of non-conductive particles is considered to be effective to inhibit concentration of discharges, not for dispersion of discharges.

Figure 3:
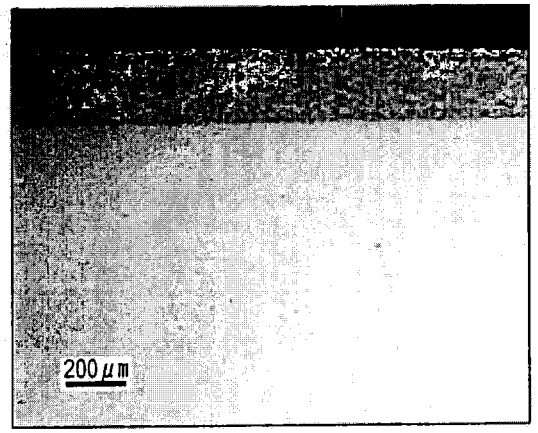
FIG. 3 is a set of photographs showing a result of comparison of an example of the discharge surface treatment method according to the first embodiment of the present invention.
Figure 3:
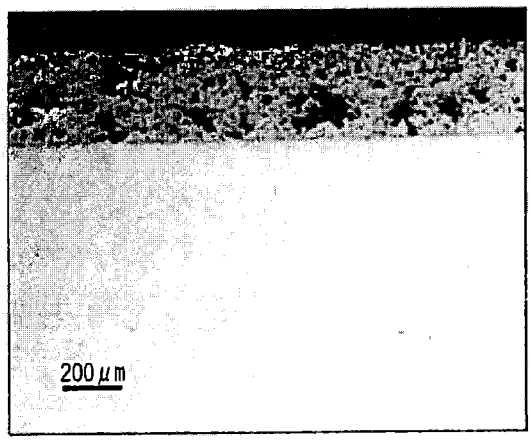
Figure 4:
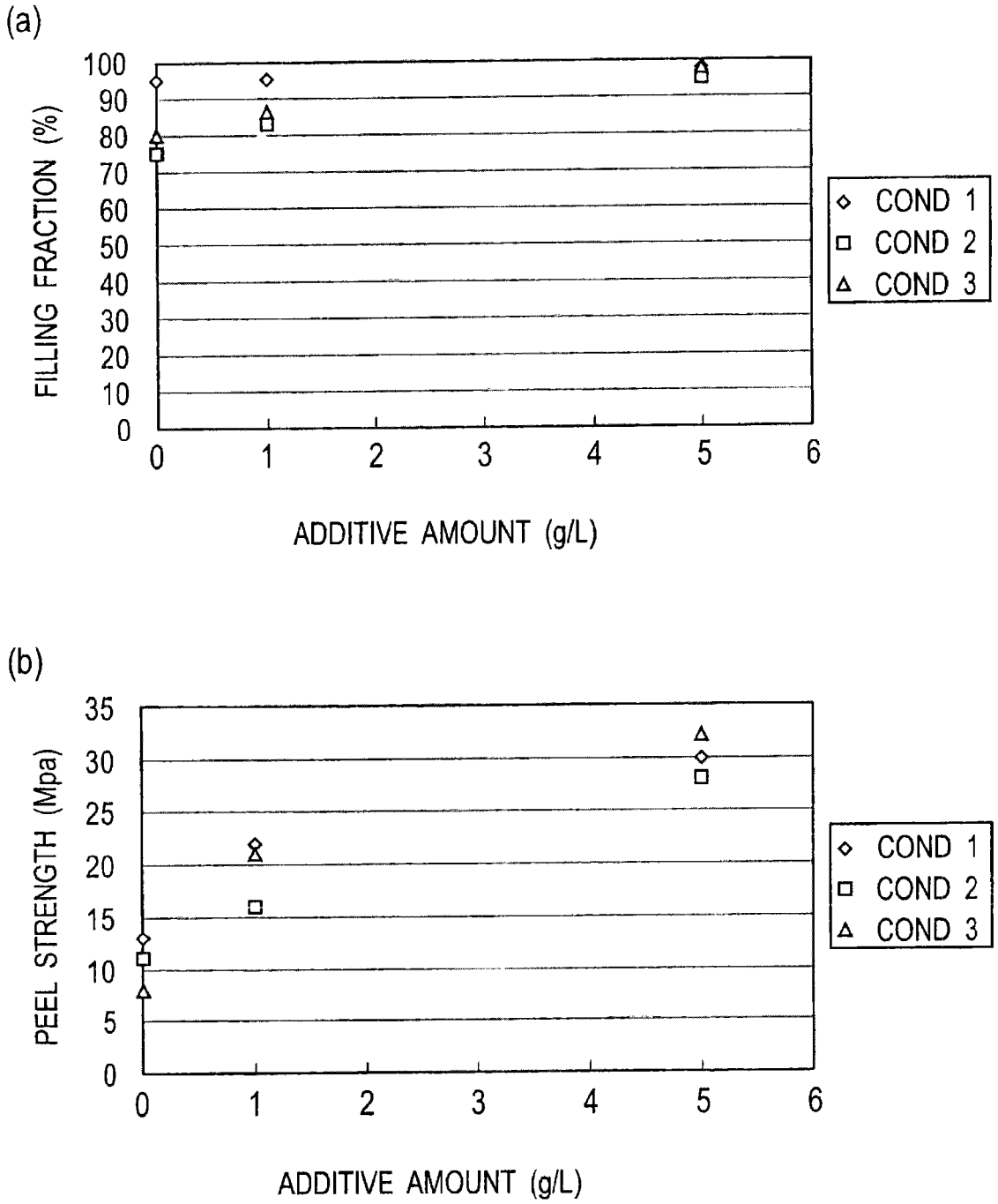
FIG. 4 is a set of graphs plotting results of comparison of other examples of the discharge surface treatment method according to the first embodiment of the present invention.

Description is now made of some examples of the discharge surface treatment method according to the first embodiment, with reference to FIGS. 3 and 4.

Embodiment Example 1

First, there was made a set of experiments for comparison to examine an electrode consumption rate and a treatment time required to form a covering film with a prescribed thickness in application of the discharge surface treatment method according to the first embodiment. As an embodiment example 1 using an electrode comprised of a compression molded compact of chrome-containing cobalt alloy powder, there was a covering film formed 0.30 mm thick in working oil with powder of Si mixed therein (mixed amount of Si powder 1 g/l). Further, as a comparative example 1 using an electrode comprised of a compression molded compact of chrome-containing cobalt alloy powder, there was a covering film formed 0.30 mm thick in working oil with no powder of semiconductor or conductor mixed therein. The embodiment example 1 and the comparative example 1 had their treatment times of discharge surface treatment and consumption rates in Z-axis direction of electrode (as feed amounts in Z-axis direction), as shown in the Table 1 below.

TABLE 1

| | Discharge surface treatment time | Z-directional consumption rate of electrode |
|---|---|---|
| Embodiment example 1 | 1 min 49 sec | 1.25 mm |
| Comparative example 1 | 9 min 52 sec | 2.70 mm |

As is apparent from comparison in between, relative to the comparative example 1 the embodiment example 1 had more dispersed discharges during discharge surface treatment, with discharge pulse pause times shortened from 64 μs to 16 μs, allowing for a reduced treating time of discharge surface treatment, as well as for a sufficient enhanced fixation ratio of electrode material or the like to a treating portion of work, with a reduced consumption rate in Z-axis direction of electrode.

Embodiment Example 2

Next, there was made a set of experiments for comparison to demonstrate a covering film formed with a uniform surface at a treating portion of work by application of the discharge surface treatment method according to the first embodiment. FIG. 3(*a*) shows, in a photograph, a section of a covering film (as an embodiment 2) formed, by a discharge surface treatment using a compression molded compact of chrome-containing cobalt alloy powder as an electrode 11, in working oil L with $ZrO_2$ particles added thereto, on a surface region (as a treating portion Wa) of a substrate (work W) made of an aluminum alloy. Those $ZrO_2$ particles then added had a powder particle size of 1.5 μm, the amount added being 5 g/l. Working oil L was set to a flow rate of 300 cc/min. On the other hand, FIG. 3(*b*) shows, in a photograph, a section of a covering film (as a comparative example 2) formed, by a discharge surface treatment using a compression molded compact of chrome-containing cobalt alloy powder as an electrode 11, in working oil L free of additives, on a surface region (as a treating portion Wa) of a substrate (work W) made of an aluminum alloy. As is apparent from comparison in between, relative to the comparative example 2 the embodiment example 2 had a covering film surface formed more uniform in shape. Further, relative to the comparative example 2 the embodiment example 2 had a densified structure with less defects in the covering film. It can thus be found that using the surface treatment method according to this embodiment enables a covering film to be formed on a treating portion of work with an enhanced uniformity over conventional surface treatment methods. This affords to provide a covering film with enhanced film strength, as well.

Embodiment Example 3

In addition (as an embodiment example 3) there was made a set of experiments for comparison to examine details of density and peel strength of a covering film formed on a treating portion of work, using the discharge surface treatment method according to the first embodiment. FIG. 4(*a*) plots filling fractions of covering films each formed, by a discharge surface treatment using a compression molded compact of chrome-containing cobalt alloy powder as an electrode 11, in working oil L with $ZrO_2$ particles added thereto, on a surface region (as a treating portion Wa) of a substrate (work W) made of an aluminum alloy. FIG. 4(*b*) plots peel strengths of covering films each formed, by a discharge surface treatment using a compression molded compact of chrome-containing cobalt alloy powder as an electrode 11, in working oil L with $ZrO_2$ particles added thereto, on a surface region (as a treating portion Wa) of a substrate (work W) made of an aluminum alloy. Those $ZrO_2$ particles then added had a powder particle size of 1.5 μm, and working oil L was set to a flow rate of 300 cc/min, while the amount of $ZrO_2$ particles added to working oil L was varied. In FIG. 4(*a*) and FIG. 4(*b*) there are plotted measures at amounts of 0 g/l, 1 and 5 g/l of $ZrO_2$ particles added to working oil L. FIG. 4(*a*) and FIG. 4(*b*) each indicate conditions 1, 2, and 3, which refer to discharge conditions. The discharge surface treatment method according to this embodiment includes generation of pulsed discharges. In the embodiment example 3, there was performed intermittent generation of stepped pulses having two sets of peak current values being a set of peak current values for initial periods, and a set of peak current values for intermediate and subsequent periods. For each of the initial periods under the conditions 1, 2, and 3, the peak current value was set to a common 30 A. For the intermediate and subsequent periods, their peak current values were set to be 1 A, 2 A, and 4.5 A. Pulse width was set to 8 μs, and pulse pause time, to 64 μs. The electrode 11 was spaced from the treating portion Wa of work W at Z-directional distances depending on gap voltages causing discharges, which was about 50 μm. As will be seen from FIG. 4(*a*) and FIG. 4(*b*), both filling rate and peel strength of covering film increased, as the amount of added $ZrO_2$ particles increased. Such tendencies were not greatly changed even with yet increased addition amounts. Instead, with addition amounts of 20 g/l or more, the discharging got unstable. The tendencies in FIG. 4(*a*) and FIG. 4(*b*) were little changed, for instance whether the material of work W was an alloy containing Fe, Ni, and Co as principal components or an alloy containing well heat-conductive Cu and Al as principal components. However, the optimum discharge condition was slightly changed in dependence on the heat conductivity of material of the work.

Second Embodiment

There will be described a second embodiment of the present invention with reference to FIG. 5.

Figure 5:
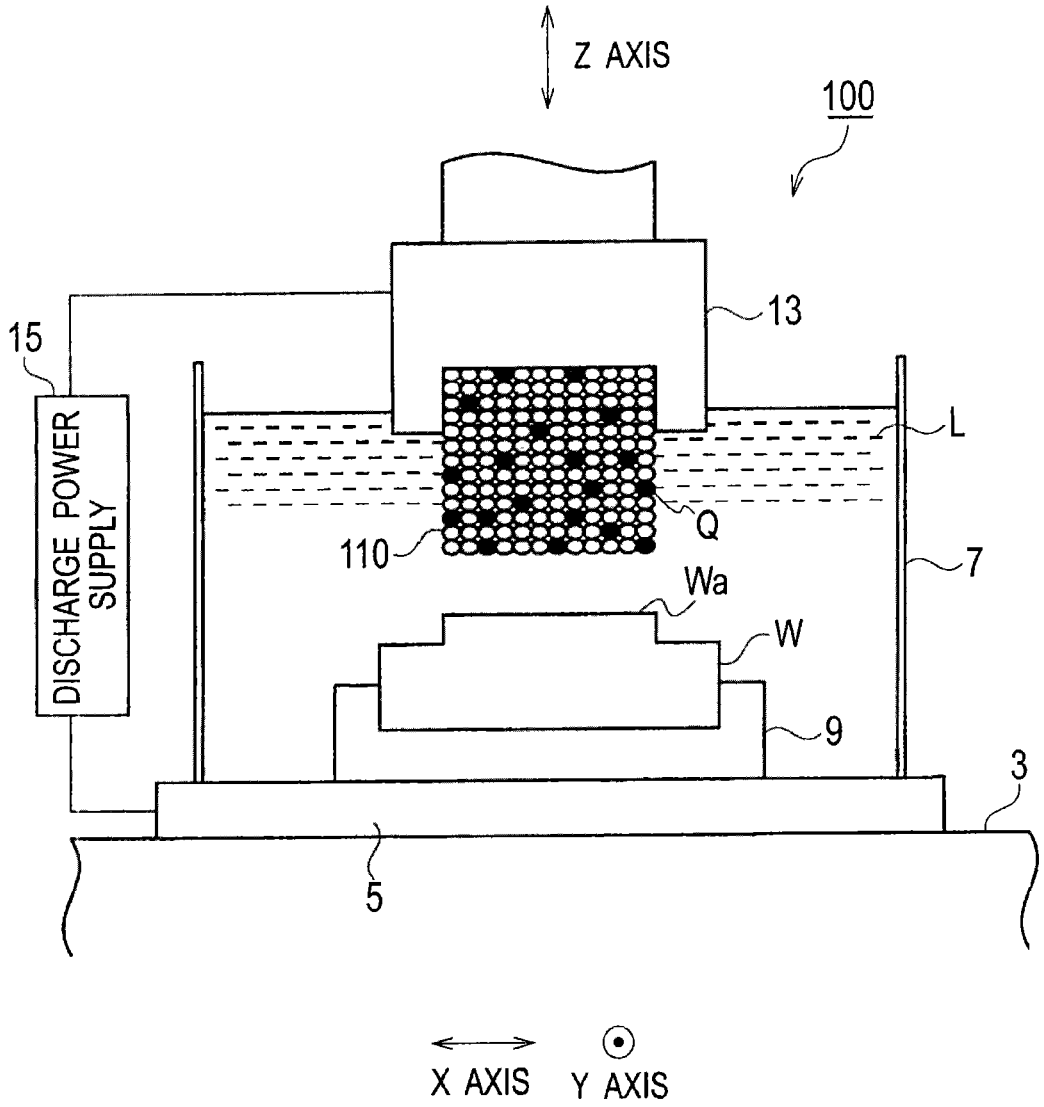
FIG. 5 is a schematic illustration of a discharge surface treatment system employed in a discharge surface treatment method according to a second embodiment of the present invention.

FIG. 5 illustrates a discharge surface treatment system 100 employed in a discharge surface treatment method according to the second embodiment, that includes a bed 3, and a table 5 mounted on the bed 3. On the table 5 there is placed an oil tank 7 with a volume of electrically insulating working oil L stored therein, having a work jig 9 put in the oil tank 7, the work jig 9 being configured to set thereon a work W such as an engine component.

Above the tale 5 there is an electrode 110 held by an electrode holder 13 set in position. The electrode holder 13 is adapted to move relative to the table 5 by combination of an X-axis servo motor (non-depicted) drivable for displacements in the X-axis direction, a Y-axis servo motor (non-depicted) drivable for displacements in the Y-axis direction, and a Z-axis servo motor (non-depicted) drivable for displacements in the Z-axis direction.

The electrode holder 13 as well as the work jig 9 is electrically connected with a discharge power supply 15. The discharge power supply 15 may be a known discharge power supply such as that disclosed in Japanese Patent Application Laying-Open Publication No. 2005-213554, and configured with capacitors, switching elements, resistor elements, and the like.

The electrode 110 is comprised of a compact (a coating block) as a compression mold of powder of a chrome-containing cobalt alloy. It is noted that the electrode 110 is not limited to a compact as a compression mold of powder of a chrome-containing cobalt alloy, and may be a compact molded from one of a powder of a metal or metals, a powder of a metal compound or metal compounds (with an alloy or alloys inclusive), a powder of ceramics, and a mixed powder of at least two of those powders. In the second embodiment, the electrode 110 has particles of powder Q of a semiconductor ceramics mixed therein in advance. In other words, according to the second embodiment, the electrode 110 is comprised of a compact (a coating block) made up by sintering a green pellet that has particles of the semiconductor ceramics premixed to one electrode material out of a group including a powder of a metal or metals, a powder of a metal compound or metal compounds, a powder of ceramics, and a mixed powder of at least two of those powders. As the semiconductor ceramics premixed, there may be cited $ZrO_2$, or else, powder of conductive material may be mixed.

Figure 6:
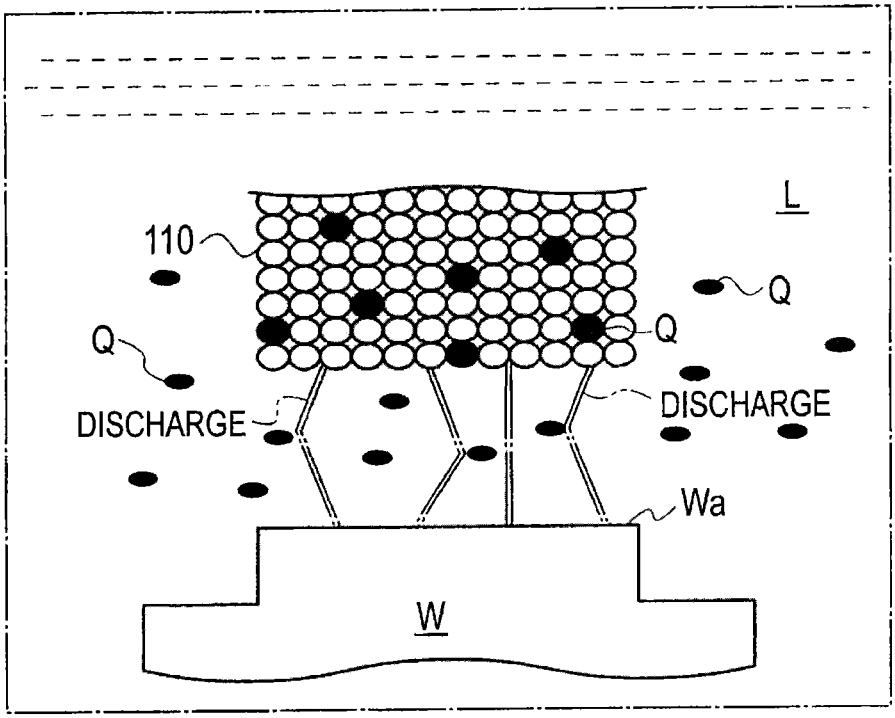
FIG. 6 is a set of illustrations describing the discharge surface treatment method according to the second embodiment of the present invention.
Figure 6:
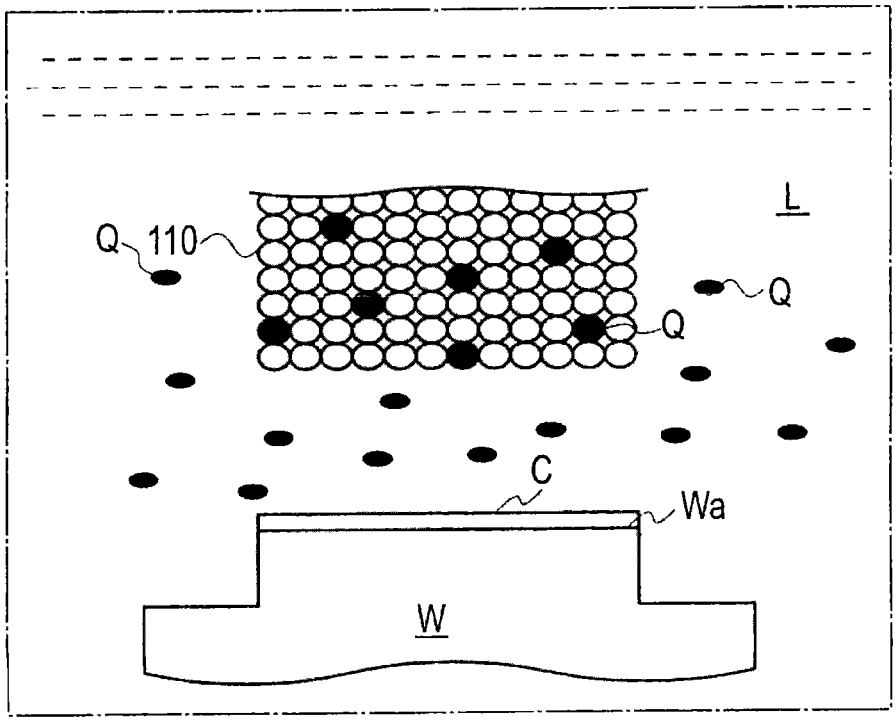

Description is now made of the discharge surface treatment method according to this embodiment, with reference to FIG. 6.

The discharge surface treatment method according to the second embodiment is based on a new knowledge such that in working oil L there may be generation of pulsed discharges between an electrode 110 as a compression mold of powder of a chrome-containing cobalt alloy with a prescribed amount of powder Q of $ZrO_2$ premixed thereto and a portion Wa of work W to be treated, to have dispersed discharges during discharge surface treatment, allowing for a sufficient enhanced fixation ratio (film forming rate) of electrode material or the like to the treating portion Wa of work W. This may be thought due to powder particles Q of $ZrO_2$ fused together with an electrode material or reactants of the electrode material and dispersed in working oil L, causing discharges to be dispersed, decreasing local treatment temperatures, suppressing evaporation of electrode material.

Further, premixing powder of $ZrO_2$ in the electrode 110 facilitates separating premixed $ZrO_2$ powder from the electrode 110 during discharge surface treatment, increasing the treatment rate. There was observation of increased treatment rates without reducing discharge pulse intervals.

For discharge surface treatment to a portion Wa of work W to be treated, first there comes setting the work W to the jig 9, followed by driving the X-axis servo motor and/or the Y-axis servo motor for moving the electrode holder 13 together with the electrode 110 to displace in the X-axis direction and/or the Y-axis direction relative to the table 5, thereby placing the electrode 110 in preset position opposite to the portion Wa of work W to be treated. This is followed by driving the Z-axis servo motor for moving the electrode holder 13 together with the electrode 110 to reciprocally displace in the Z-axis direction, while operating the discharge power supply 15 to have pulsed discharges generated, as illustrated in FIG. 6(*a*), between the electrode 110 and the treating portion Wa of work W in working oil L. This involves attendant discharge energies locally fusing surface regions of the treating portion Wa of work W, while showering molten pieces of electrode material or reactants of the electrode material onto the treating portion of work W, affording as illustrated in FIG. 6(*b*) to form a covering film C on the treating portion Wa of work W.

The discharge surface treatment method according to the second embodiment permits the film forming rate (as the covering film generation rate) to be enhanced two to three folds in comparison with discharge surface treatments using an electrode without premixed powder Q of semiconductor ceramics in electrode 110. This is accompanied by a consumption rate of electrode 110 proportional to the generation rate of covering film. Also, there is enhancement of a fixation ratio of electrode material to the treating portion Wa of work W.

Figure 7:
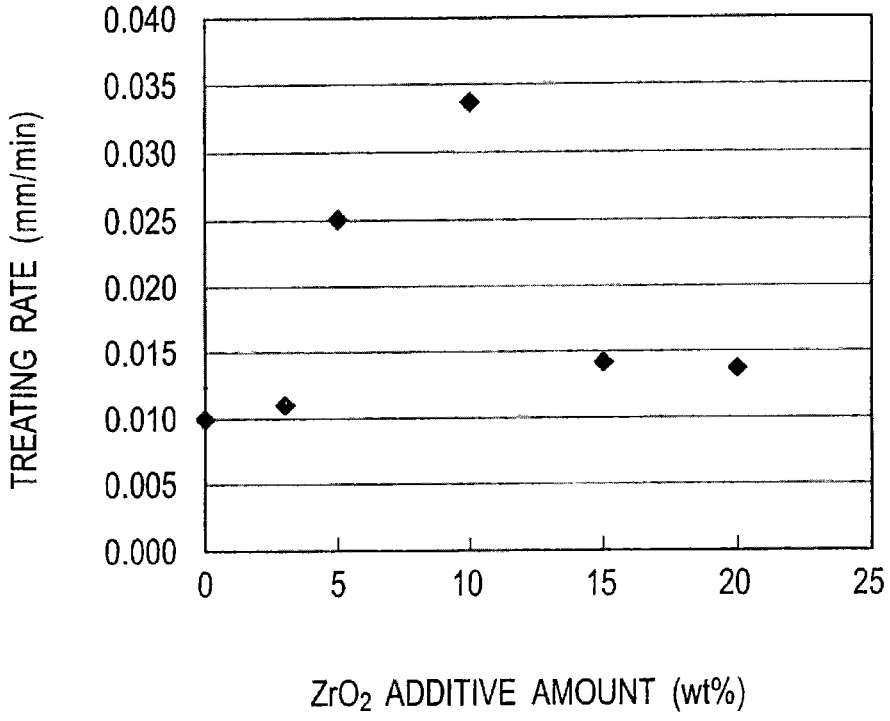
FIG. 7 is a graph plotting results of experiments on an example of the discharge surface treatment method according to the first embodiment of the present invention.

Description is now made of an example of the discharge surface treatment method according to the second embodiment, with reference to FIG. 7.

Embodiment Example

FIG. 7 plots in a graph a relationship the treating rate of film formation (as the film forming rate) had to addition amounts of $ZrO_2$ powder Q premixed in electrodes 110 having a chrome-containing cobalt alloy powder as an electrode material thereof. As used herein, the film forming rate means a height of film formed per one minute (as a cladding rate) at a treating portion Wa of work W. Added $ZrO_2$ powder Q had particle sizes of 5 to 10 μm. Specific values of plot data in FIG. 7 were as shown in Table 2 below.

TABLE 2

| Addition amounts of $ZnO_2$ (wt %) | Treating rates (mm/min) |
|---|---|
| 0 | 0.010 |
| 3 | 0.011 |
| 5 | 0.025 |

TABLE 2-continued

| Addition amounts of $ZnO_2$ (wt %) | Treating rates (mm/min) |
|---|---|
| 10 | 0.034 |
| 15 | 0.014 |
| 20 | 0.014 |

As will be seen from Table 2, it is found that using an electrode 110 with an addition amount of 10% by weight of $ZrO_2$ powder Q in the discharge surface treatment method according to the second embodiment does permit the treating rate of film formation to be enhanced about 3.5 folds or near in comparison with a discharge surface treatment using an electrode without premixed powder Q of $ZrO_2$ in electrode 110 (corresponding to an addition amount of 0 wt % of $ZrO_2$ powder Q in Table 2). Also from FIG. 7, it is found that the treating rate has a maximum value with an addition amount of $ZrO_2$ powder Q in a vicinity of 10 wt %. More specifically, there is seen such a tendency that the treating rate of film formation rises at an addition amount of $ZrO_2$ powder Q near 3 wt %, getting maximum near 10 wt %, and afterward, gradually decreases to converge on a steady value to be held past 15 wt % or near.

The present invention is not limited to the embodiments described. For instance, the first embodiment and the second embodiment may be combined to provide another embodiment. That is, there may be combined use of a volume of working oil prepared as a mixture with one of a powder of semiconductor, a powder of conductor, a powder of non-conductive particles, and a mixed powder of two or more of those powders, and a compact (as a coating block) of an electrode material made of one of a powder of metal, a powder of metal compound, a powder of ceramics, and a mixed powder of two or more of these powders, having a powder of semiconductor ceramics premixed thereto. Also, the scope of appended claims is limited to the embodiments described.

INDUSTRIAL APPLICABILITY

According to the first embodiment of the present invention there is generation of pulsed discharges between an electrode and a portion of work to be treated in a volume of working oil prepared as a mixture with one of a powder of semiconductor, a powder of conductor, a powder of non-conductive particles, and a mixed powder of at least two of those powders, thus having dispersed discharges during discharge surface treatment, allowing for a sufficient enhanced fixation ratio of electrode material or the like to the treating portion of work.

According to the second embodiment of the present invention there is use of a compact (as a coating block) of an electrode material made of one of a powder of metal, a powder of metal compound, a powder of ceramics, and a mixed powder of at least two of those powders, having a powder of semiconductor ceramics premixed thereto, as an electrode for generating pulsed discharges between the electrode and a portion of work to be treated, thus having dispersed discharges during discharge surface treatment, allowing for a sufficient enhanced fixation ratio of electrode material or the like to the treating portion of work.

According to the present invention, there is a system of discharges dispersed in a field discharge surface treatment, constituting a difficulty to cause concentrated discharges, affording to minimize time intervals between discharges in discharge surface treatment, permitting the treatment time to be shortened, allowing for well enhanced productivity.

Further, the treating portion of work is afforded to have a sufficient enhanced fixation ratio of electrode material or the like to the treating portion of work, to increase the yield of electrode, allowing for a reduced treatment cost in the discharge surface treatment.

What is claimed is:

1. A coating block comprising a sintered compact comprising a powder of $ZrO_2$ mixed with at least one electrode material, wherein the electrode material is a powder of a metal, a content of the $ZrO_2$ powder is from 3% to 15% by weight to the electrode material, and the compact further comprises a powder of a chromium-containing cobalt alloy.

2. The coating block of claim 1, wherein the content of the $ZrO_2$ powder is 10% by weight to the electrode material.

3. The coating block of claim 1, wherein a powder particle size of the $ZrO_2$ powder is from 5 to 10 μm.

4. The coating block of claim 1, wherein the sintered compact is a sintered green pellet.

5. The coating block of claim 1, wherein the coating block is capable of generating a discharge energy between the coating block and a treating portion of work in a working oil.

6. The coating block of claim 1, wherein the content of the $ZrO_2$ powder is from 5% to 15% by weight to the electrode material.

7. The coating block of claim 1, wherein the content of the $ZrO_2$ powder is from 5% to 10% by weight to the electrode material.

* * * * *